United States Patent [19]

Spector

[11] 4,349,223

[45] Sep. 14, 1982

[54] BURGLAR PROOF BOLT

[76] Inventor: Nancy R. Spector, 75-11 188th St., Flushing, N.Y. 11366

[21] Appl. No.: 172,285

[22] Filed: Jul. 25, 1980

[51] Int. Cl.[3] ..... E05C 19/00

[52] U.S. Cl. ..... 292/259 R

[58] Field of Search ..... 292/259, 260, 142, 144, 292/172

[56] References Cited

U.S. PATENT DOCUMENTS

| | | | |
|---|---|---|---|
| 1,480,643 | 1/1924 | Thompson | 292/DIG. 18 |
| 1,623,853 | 4/1927 | Rhodes | 292/259 |
| 1,707,694 | 4/1929 | Torrence | 292/259 X |
| 3,933,382 | 1/1976 | Counts et al. | 292/144 |
| 3,996,591 | 12/1976 | Hayward | 292/144 |

*Primary Examiner*—Richard E. Moore

*Attorney, Agent, or Firm*—Richard L. Miller

[57] ABSTRACT

A sliding bolt for sliding across an inner side of a door of a home so as to more strongly resist against the door being forced open by an intruder; a two-directional electric motor moving the heavy bolt in both directions for sliding through U-shaped brackets mounted on the rear of the door and also on wall adjacent each side of the door.

1 Claim, 4 Drawing Figures

10
2
3
11
18
24
19
13
16
20
14
21
27
33
12
25
26
15
17

24
11
19
18
31
32
27
22
23

22
23
29
30
28
27
31

712
34
36
35
37
25

BURGLAR PROOF BOLT

BACKGROUND OF THE INVENTION

This invention relates generally to door locking devices.

It is well known that a conventional door lock may not positively prevent an intruder from breaking through and entering a home. Many of the locks can be quickly unlocked by simply sliding a fairly stiff, thin plastic card between the door and door jamb so as to slide the bolt out of the jamb and back into the lock. Others using a dead bolt so as to prevent the above-described easy unlocking, may still be unlocked by a burglar who is stilled in lock-picking by pins through the key opening. Still other unauthorized entry may be made by simply giving the door a sharp kick by a foot, so that the bolt-holding fitting mounted in the door jamb will split the wood of the jamb and is pushed out from the jamb. Even the use of long mounting screws for this fitting cannot prevent such break-in if the door jamb wood is weakened by becoming rotted or dried out so as to easily split. This situation is accordingly in need of an improvement.

SUMMARY OF THE INVENTION

Therefore it is a principal object of the present invention is to provide a burglar-proof bolt for sliding across a rear of the door so that neither an opening of the door lock nor a violent kick against the door can open the door.

Another object is to provide a burglar-proof bolt which can however be easily opened by a resident entering his home by use of a remote control carried by the person and which electronically activates a motor that slides the bolt open.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF PREFERRED EMBODIMENT

Figure 1:
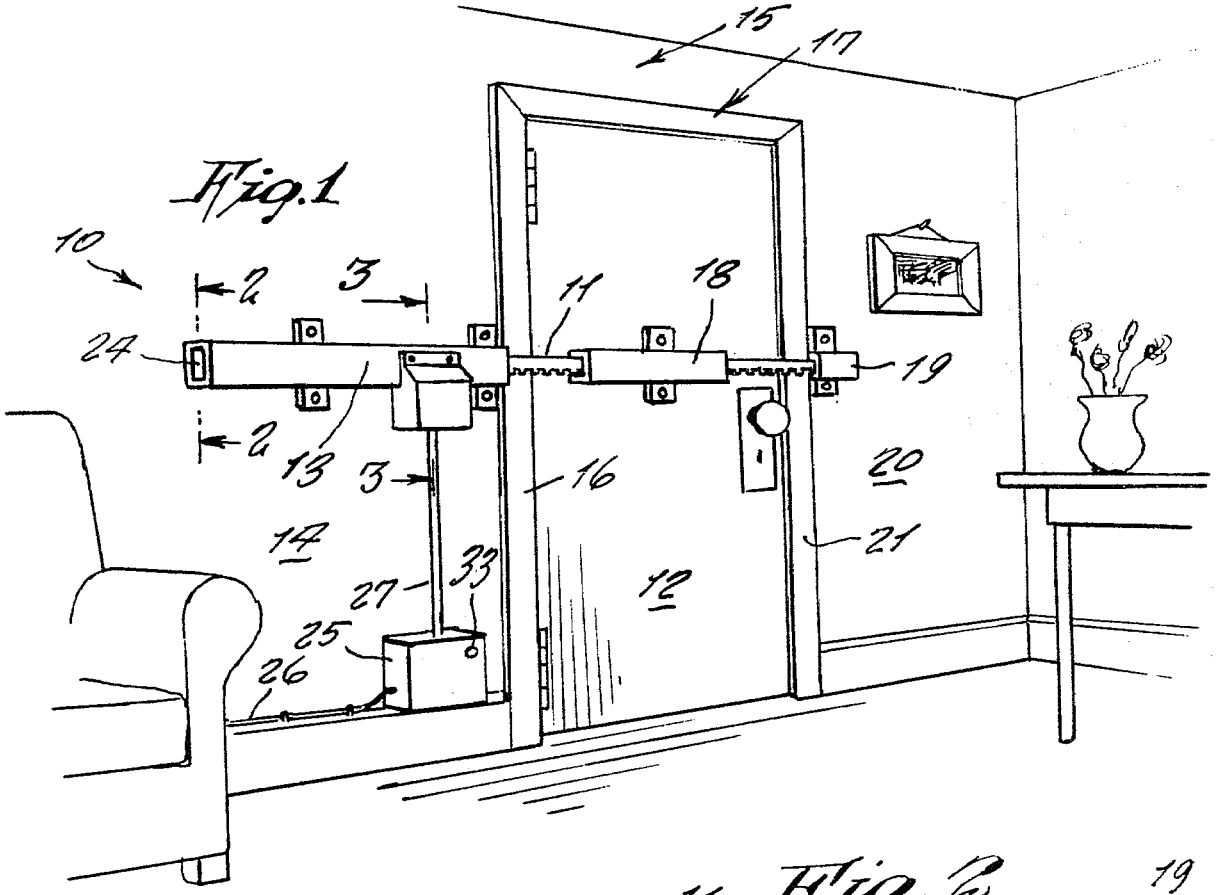
FIG. 1 is a perspective view of the invention shown installed inside a home and securing a door in bolted position.

Referring now to the drawing in greater detail, the reference numeral 10 represents a burglar-proof bolt assembly according to the present invention, wherein there is a large and very strong, steel bolt 11 for sliding behind a rear of a door 12 so as to prevent the door from being swinged open even if the door lock is unlocked, and which also prevents a force of a violent kick from splintering the wood of the door jamb by resisting the force being applied thereto.

The bolt at all times is slided in a long bracket 13 secured to a portion 14 of a wall 15 which is located adjacent one vertical side edge 16 of a door jamb 17; the bolt being partly slidable out of the bracket 13 so as to slide through a second bracket 18 secured to a rear side of the door, and slided also into a third bracket 19 secured to a wall portion 20 located adjacent an opposite vertical side edge 21 of the door jamb. All the brackets are made of a strong, forged steel and include pads 22 through which mounting bolts or long screws 23 are fitted for securement of the bracket to either the wall or door. Each bracket includes an opening 24 therethrough and through which the bolt slides.

The present invention includes a two-directional electric motor 25 for sliding the heavy bolt into either locking or unlocking positions, the motor being connected by an extension cord 26 to a household electric outlet socket.

The motor is preferably located low along the wall so as to not be seen and further detract from the room appearance, while the sliding bolt is preferably across a vertical mid-portion of the door. A shaft 27, driven by the motor, causes a bevel gear 28 on its end to turn a bevel gear 29 affixed on a shaft 30 supported on bracket 13. A gear 31 also affixed on shaft 30 engages a toothed rack 32 along one edge of the sliding bolt 11.

Figure 2:
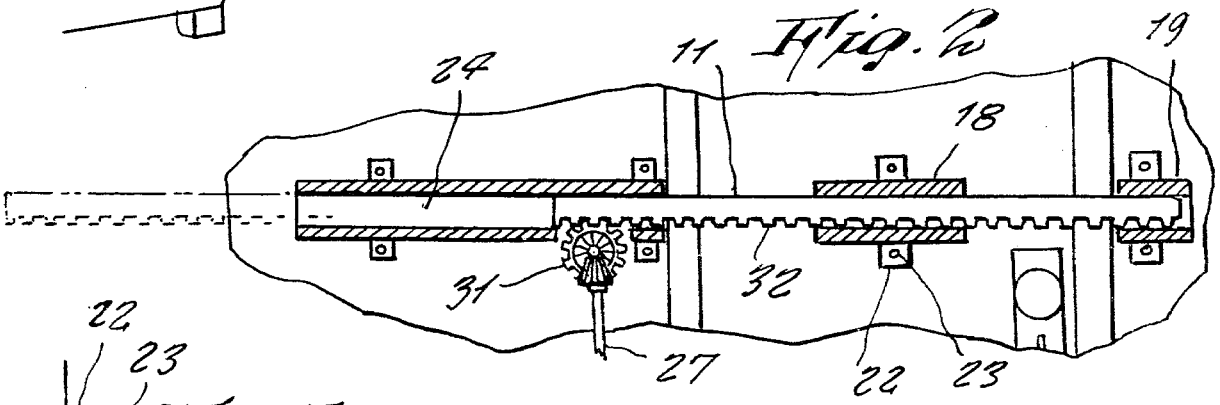
FIG. 2 is a cross sectional view on line 2—2 of FIG. 1.
Figure 3:
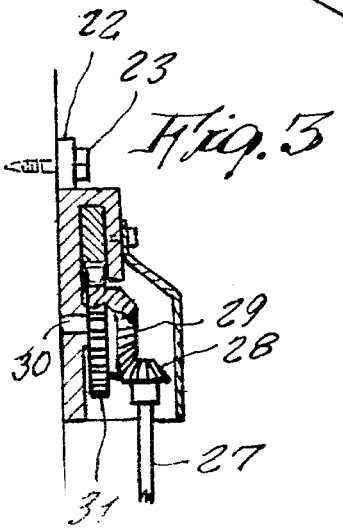
FIG. 3 is a cross sectional view on line 3—3 of FIG. 3.

Thus in operative use, the gear 29 always engages the toothed rack, whether the bolt is slided into unlocked position, as shown by phantom lines in FIG. 2, or whether the bolt is slided into door locking position as shown by solid lines in the same figure.

Figure 4:
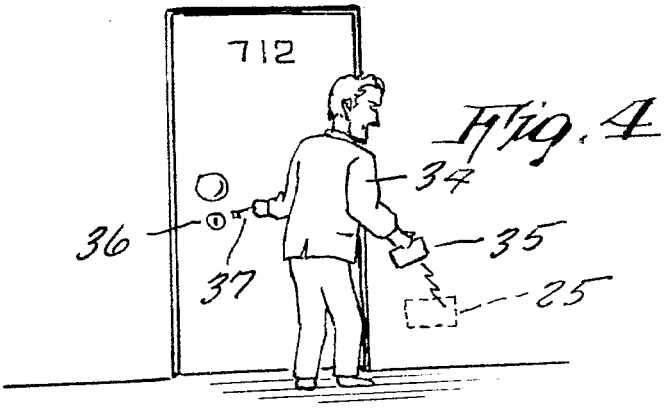
FIG. 4 is a view outside of the door showing a resident unlocking and unbolting the door in order that he may enter his residence.

The electrical circuit for operating the motor may include a pushbutton 33 located anywhere inside the home for operating the device by a person at home. The electrical circuit also includes a remote controlled switch, also inside the home so as to not be visible from the outside of the home, and which can be activated by the resident 34 outside, when coming home, by means of a remote control unit 35 that he carries. Thus as shown in FIG. 4, while he is unlocking the door lock 36 by a key 37, he may at a same time, slide the door bolt 11 into unlocked position, so as to open the door and enter the home.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A burglar-proof bolt assembly, comprising in combination, a first bracket affixed on a wall inside a home at one side of an entry door, a second bracket affixed on a wall at an opposite side of said door, and a third bracket secured to an inner side of said door, said brackets being aligned, and a bolt stored in said first bracket being slidable through said second and third brackets so as to secure said door from an intruder outside; an electric motor mounted on said wall to which said first bracket is affixed said motor being connected to an electric power of said home, a gear driven by said motor engaging a toothed rack along said bar; and a remote control unit carried by a resident when outside of said home, said remote control unit including means to activate said motor for sliding said bolt and lock or unlock said door.

* * * * *